United States Patent [19]

Nordstrom et al.

[11] Patent Number: 5,012,972

[45] Date of Patent: May 7, 1991

[54] PAPERBOARD CONTAINER WITH CONTENT INDICATING WINDOW

[75] Inventors: Duane M. Nordstrom, Kelso; Harold L. Baker, Longview, both of Wash.

[73] Assignee: Longview Fibre Company, Longview, Wash.

[21] Appl. No.: 428,091

[22] Filed: Oct. 27, 1989

[51] Int. Cl.[5] ..... B65D 25/54

[52] U.S. Cl. ..... 229/162; 206/45.31; 220/462

[58] Field of Search ..... 229/109, 110, 4.5, 5.5, 229/162; 222/156, 157; 220/82 R, 416, 441, 462; 206/45.31

[56] References Cited

U.S. PATENT DOCUMENTS

| | | | |
|---|---|---|---|
| 1,992,182 | 2/1935 | Buist | 229/5.5 |
| 2,177,918 | 10/1939 | Vogt et al. | 206/45.31 |
| 2,532,857 | 12/1950 | Ricciardi | 229/162 |
| 3,200,942 | 8/1965 | Wagner | 206/45.31 |
| 3,217,923 | 11/1965 | Price | 220/82 R |
| 3,400,878 | 9/1968 | Heller, Jr. et al. | 229/162 |
| 3,690,523 | 9/1972 | Link | 229/162 |
| 3,853,216 | 12/1974 | Jaeschke | 206/45.31 |
| 4,363,240 | 12/1982 | Mikusaki | 220/82 R |
| 4,759,935 | 7/1988 | Toshitsugu | 206/45.31 |

FOREIGN PATENT DOCUMENTS

| | | | |
|---|---|---|---|
| 187334 | 7/1986 | European Pat. Off. | 229/162 |
| 449834 | 9/1927 | Fed. Rep. of Germany | 206/45.31 |
| 7808598 | 2/1980 | Netherlands | 206/45.31 |

*Primary Examiner*—Gary E. Elkins

*Attorney, Agent, or Firm*—Olson & Olson

[57] ABSTRACT

A container is formed of a pair of paperboard tubular walls open at both ends and one telescoped within the other. A liquid impervious transparent liner is confined within the inner wall and the ends of the walls are closed by top and bottom closures. A fitment is attached to the liner and extends outward through the tubular walls for connection of a dispensing control valve. One or more liquid level indicating windows is provided by forming registering openings in the inner and outer tubular walls and pressing a transparent cup into each opening in the inner tubular wall before telescoping the inner and outer tubular walls together. A peripheral flange on the cup abuts the outer surface of the inner tubular wall and is secured in place by being sandwiched between the inner and outer tubular walls. In an alternative container construction, a single container wall is used, and the cup flange is abutted against and, if desired, secured to the confronting inner or outer surface of the container wall.

13 Claims, 1 Drawing Sheet

PAPERBOARD CONTAINER WITH CONTENT INDICATING WINDOW

BACKGROUND OF THE INVENTION

This invention relates to containers for bulk contents, and more particularly to a container made of paperboard and including a novel window which provides visibility into the container for indicating the level and/or content of the container.

Liquid containers with liquid level indicating windows have been provided heretofore. However, they are characterized by requiring complex and costly structural configurations to be incorporated in the container to secure correspondingly complex and costly window structures. Typical of these are disclosed in U.S. Pat. Nos. 292,532; 420,781; 2,172,864; 3,205,764; 4,363,240 ; and 4,376,490.

U.S. Pat. Nos. 3,017,987 discloses a container with transparent windows in which the container is molded of polyethylene having a thickness which renders it opaque, but with integral window portions molded to a thinner cross section which renders the windows transparent. The sizes and shapes of the containers are limited by the practical costs and dimensional limitations of the plastic molding dies.

SUMMARY OF THE INVENTION

In its basic concept, the container of this invention includes a peripheral side wall of corrugated or solid fiber paperboard provided with one or more content-indicating openings each of which receives a transparent cup-shaped window, the cup having the shape of the opening in the side wall and a depth substantially equal to the thickness of the side wall, and an outwardly extending flange on the open end of the cup for abutting the confronting surface of the side wall. When the container is made of a single side wall, the flange may be bonded or otherwise secured to either the inner or the outer side of the side wall. When the container is made of inner and outer telescoped side walls, the flange is retained in position by being sandwiched between the inner and outer side walls, and the outer side wall is provided with an opening registering with each opening in the inner side wall.

It is by virtue of the foregoing basic concept that the principal objective of this invention is achieved; namely, to overcome the aforementioned complications and costs associated with prior containers with content-indicating windows.

Another object of this invention is the provision of a paperboard container of the class described which includes a transparent window of simplified and economical construction for quick and easy insertion into an opening merely punched out of the paperboard side wall of the container.

The foregoing and other objects and advantages of this invention will appear from the following detailed description, taken in connection with the accompanying drawings of a preferred embodiment.

DESCRIPTION OF THE PREFERRED EMBODIMENT

Figure 1:
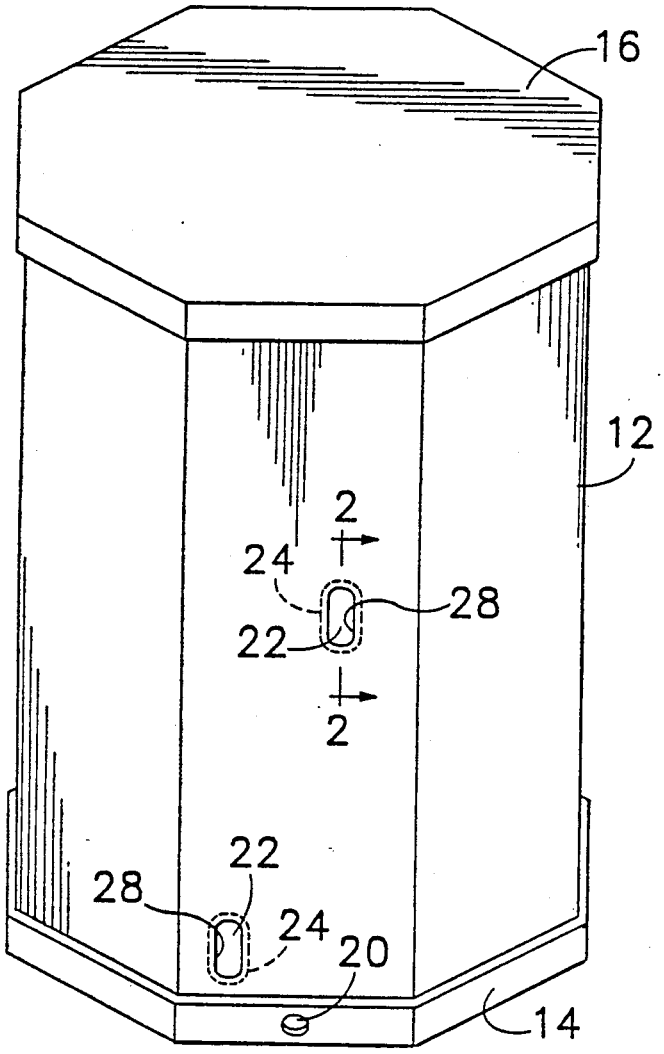
FIG. 1 is a front perspective view of a paperboard container with liquid level indicating windows embodying the features of this invention.
Figure 2:
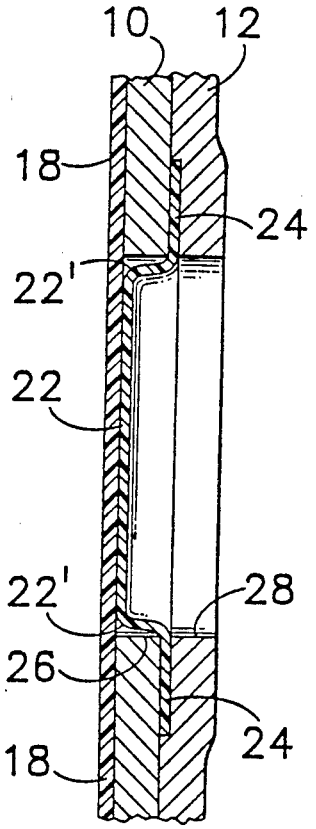
FIG. 2 is a fragmentary vertical sectional view, on an enlarged scale, taken on the line 2—2 in FIG. 1.

For the purpose of this description, FIGS. 1 and 2 of the drawings shown a paperboard container for liquids of the type disclosed in U.S. Pat. No. 4,666,059 which has common assignee with this application. Thus, the container includes inner and outer tubular walls 10 and 12, respectively, which preferably are made of corrugated paperboard. Although the shape of the container illustrated is octagonal, it will be understood that it may be provided in any other shape desired.

The side walls are open at their ends which are closed by means of a bottom cap member 14 and a top cap member 16. Although the cap members are shown to include outer peripheral walls which encircle corresponding end portions of the tubular side walls, other forms of cap members may be employed, as desired.

A liquid impervious liner 18 of transparent, flexible material, such as polyethylene or other suitable synthetic resin, is contained within the interior of the tubular wall assembly. This may be effected by any method desired, such as by the method described in detail in the U.S. Pat. No. 4,666,059 mentioned hereinbefore. The liner is provided with a fitment to which a dispensing control valve subsequently may be attached for dispensing the liquid contents which is confined within the liner. The fitment extends outwardly through appropriate registering openings in the tubular walls, as by the specific arrangement described in the patent aforesaid. When the bottom cap member is provided with a peripheral wall, as illustrated, an opening 20 in said wall is configured to receive the fitment, as will be understood.

In accordance with this invention, the container is provided with one or more content indicating windows. FIG. 1 illustrates two such windows, one for indicating when the container is about half filled and the second for indicating when the container is nearly empty. It will be understood that the number of windows may be varied, as desired.

The window is formed as a cup 22 provided at its open end with a laterally outwardly extending flange 24. The cup is made of transparent material in order to view the level of liquid in the transparent liner 18. The cup preferably is molded of flexible, synthetic resin. The flange preferably extends around the entire periphery of the cup, although the flange may be segmented peripherally.

The cup is configured for reception in an opening 26 in the inner tubular wall 10. To this end the shape of the cup substantially matches the peripheral shape of the opening 26. The depth of the cup is substantially equal to the thickness of the inner tubular wall 10, and the outer peripheral surface 22' of the cup bottom is rounded. The depth of the cup prevents snagging of the thin liner 18 on the peripheral inner edge of the opening 26, and the rounded outer periphery 22' of the cup allows free movement of the liner 18 during its installation in the inner tubular wall 10 and its filling with liquid.

In the embodiment illustrated in FIGS. 1 and 2, the container includes inner and outer tubular walls 10 and 12, respectively, as previously described. Accordingly, the outer wall 12 also is provided with an opening 28 registering with each opening 26 in the inner wall 10. The shape of the opening 28 preferably is the same as opening 26. In any case, the opening 28 must not be as large as the outer periphery of the flange 24, since the flange is secured in place by being sandwiched between the walls 10 and 12.

The openings 26 and 28 preferably are provided in the inner and outer tubular walls 10 and 12, respectively, by broken cut lines defining the periphery of the openings. Such lines are provided by conventional stamping technique well known in the art. Accordingly, the container may be utilized with or without liquid level indicating windows. Alternatively, the openings may be provided by a continuous cut line defining the periphery of the opening.

When the windows are to be provided, the opening blanks, defined by broken cut lines, are punched out. A transparent cup 22 then is pressed into each opening 26 in the inner wall 10, with the flange 24 abutting the outer surface of the inner wall. The inner and outer walls then are telescoped, bringing the upper and lower ends of both walls into registry. The openings 28 in the outer wall 12 thus are brought into registry with openings 26 in the inner wall, with the cup flange 24 captured between the walls.

The outer opening 28 not only allows viewing of the liquid through the transparent cup 22 and liner 18, it also affords protection of the cup from puncture or other inadvertent damage from external objects, because it spaces the cup a substantial distance inward of the outer surface of the container.

Figure 3:
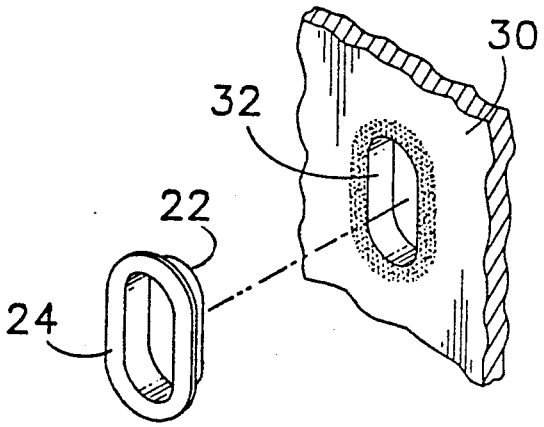
FIG. 3 is an exploded fragmentary perspective view illustrating the manner of installation of a window in an opening in a container side wall.

The exploded view of FIG. 3 illustrates the method of inserting a cup into an opening in the side wall of a paperboard container. The figure also illustrates an alternative construction of container embodying the features of this invention. In this embodiment, the container is formed of a single side wall 30, instead of the double wall construction of FIGS. 1 and 2. Accordingly, the transparent cup 22 may be pressed into the opening 32 from either the inner side or the outer side of the wall. An adhesive may be applied to the confronting surface of either the cup flange 24, or the wall 30 adjacent the opening 32, for securing the flange to the wall. If the flange is placed against the inner surface of the container side wall, the contents of the container may serve to retain the cup within the opening.

Figure 4:
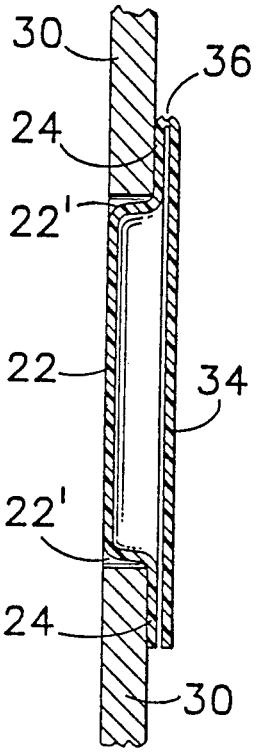
FIG. 4 is a fragmentary horizontal sectional view, similar to FIG. 2, showing a modified form of window embodying the features of this invention.

The embodiment illustrated in FIG. 4 adds to the previously described embodiment a flap 34 which is arranged to overlie the open end of the cup 22. When the flap is located adjacent the contents, it prevents entry into the cup of the contents of the container, or of the liner 18 in which the contents is confined. It also provides added protection against puncture by external objects. The cup also may be positioned with the flap facing the outer side of the container wall.

The flap 34 preferably is formed as an integral part of the cup. As illustrated, it is molded as a lateral extension of one side of flange 24, with a thinned or perforated line 36 forming a hinge which allows the flap to be folded over the open end of the cup. In the alternative, the flap 34 may be a separate plate bonded or otherwise secured to the cup flange by adhesive, solvent or other appropriate means.

It will be apparent to those skilled in the art that various modifications and changes may be made in the size, shape, type, number and arrangement of parts described hereinbefore. For example, the container may be configured for housing solid substances or objects. In such event the liner may be omitted and a window may be provided for identifying the content. If the container is to house a solid substance in particulate form, the liner may be used if desired and one or more windows may be located to identify levels. The cup may be located in an opening in either the inner wall or outer wall, with the cup flange sandwiched between the walls or abutting either the inner surface of the inner wall or the outer surface of the outer wall. The foregoing and other modifications and changes may be made without departing from the spirit of this invention and the scope of the appended claims.

We claim:

1. A container with content indicating window, comprising:
   (a) a container side wall having inner and outer surfaces,
   (b) an opening through the side wall providing visibility into the container,
   (c) a transparent cup member in said opening having a closed end and an open end, said closed end of the cup member being located substantially coplanar with the inner surface of the container side wall,
   (d) a flange extending laterally outward from the open end of the cup member and abutting the outer surface of the container side wall, and
   (e) a transparent flexible liner within the container side wall for confining contents therein.

2. The container of claim 1 wherein the cup member is made of flexible synthetic resin.

3. The container of claim 1 wherein the flange and confronting surface of the container side wall are secured together.

4. A container with liquid level indicating wwindow, comprising:
   (a) inner and outer tubular side walls having open ends and inner and outer surfaces,
   (b) end cap members removably closing the open ends of the side walls,
   (c) a transparent flexible liner within the inner side wall for containing a liquid,
   (d) at least one opening through the inner side wall,
   (e) an opening through the outer side wall registering with each opening through the inner side wall,
   (f) a transparent cup member in each opening in the inner tubular wall, the cup member having a closed end and an open end, the closed end of the cup member being located substantially coplanar with the inner surface of the inner side wall, and
   (g) a flange on each cup member extending outwardly from the open end of the cup member and being sandwiched between the inner and outer side walls.

5. The container of claim 4 wherein the tubular side walls and end cap members are made of paperboard.

6. A container with content indicating window, comprising:
   (a) a container side wall including inner and outer side walls,
   (b) registering openings through the inner and outer side walls providing visibility into the container,
   (c) a transparent cup member in an opening in either side wall, the cup member having a closed end and an open end, and (d) a flange extending laterally outward from the open end of the cup member and abutting the adjacent surface of the container side wall.

7. The container of claim 6 wherein the flange of the cup member is sandwiched between the inner and outer side walls.

8. The container of claim 7 including a transparent flexible liner within the inner side wall.

9. The container of claim 8 wherein the side walls are made of paperboard and the cup member and liner are made of synthetic resin.

10. A container with content indicating window comprising:

(a) a container side wall, (b) an opening through the side wall providing visibility into the container, (c) a transparent cup member in said opening having a closed end and an open end, (d) a flange extending laterally outward from the open end of the cup member and abutting the adjacent surface of the container side wall, and (e) a cup flap overlying the open end of the cup member.

11. The container of claim 10 wherein the cup flap is secured to the flange along one side of the flange.

12. The container of claim 11 wherein the cup flap is formed as a lateral extension of one side of the flange.

13. The container of claim 12 including hinge means between the cup flap and flange for facilitating folding the flap over the open end of the cup member.

* * * * *